United States Patent [10]

Terasaki

[11] 4,045,886

[45] Sept. 6, 1977

[54] MEANS FOR REDUCING FATIGUE FROM WEARING FOOTGEAR

[76] Inventor: Katsuhisa Terasaki, 43, Okimiyacho, Edogawa, Tokyo, Japan, 133

[21] Appl. No.: 698,709

[22] Filed: June 22, 1976

[30] Foreign Application Priority Data

June 30, 1975 Japan ..... 50-91371[U]
Feb. 19, 1976 Japan ..... 51-18739[U]

[51] Int. Cl.[2] ..... A43B 13/38
[52] U.S. Cl. ..... 36/44
[58] Field of Search ..... 36/44, 43; 128/607, 128/613, 601, 602, 603, 596, 586

[56] References Cited

U.S. PATENT DOCUMENTS

| | | | |
|---|---|---|---|
| 466,592 | 1/1892 | Bailey | 36/44 X |
| 1,302,760 | 5/1919 | Block | 128/603 |
| 2,193,174 | 3/1940 | Knupp | 128/603 |
| 2,295,212 | 9/1942 | Hamel | 128/613 |
| 2,433,329 | 12/1947 | Adler et al. | 36/44 X |
| 2,748,503 | 6/1956 | Scholl | 36/44 X |
| 3,028,857 | 4/1962 | Parker | 36/43 X |
| 3,589,037 | 6/1971 | Gallagher | 36/44 |
| 3,722,113 | 3/1973 | Birkenstock | 36/11.5 |
| 3,859,727 | 1/1975 | Nakamoto | 36/11.5 |

FOREIGN PATENT DOCUMENTS

| | | | |
|---|---|---|---|
| 526,157 | 6/1931 | Germany | 128/603 |
| 936,975 | 12/1955 | Germany | 36/44 |

*Primary Examiner*—Alfred R. Guest
*Attorney, Agent, or Firm*—Birch, Stewart, Kolasch and Birch

[57] ABSTRACT

A sheet piece placed on the insole of a shoe so as to support only the arch portion of the foot. The sheet piece may preferably be used in combination with an insole sheet wherein the sheet piece has a plurality of projections which engage into a plurality of openings formed in the insole sheet. The sheet piece may include first and second pieces attached on opposite surfaces of the insole sheet, wherein the second piece may be attached to the bottom surface of the insole sheet and may be constructed from less expensive material and provided in a plurality for one combination of the insole sheet and the first sheet piece.

5 Claims, 8 Drawing Figures

MEANS FOR REDUCING FATIGUE FROM WEARING FOOTGEAR

BACKGROUND OF THE INVENTION

1. Field of the Invention

The present invention relates to means for reducing fatigue from wearing footgear.

2. Description of the Prior Art

Relatively expensive footgear such as leather shoes are generally formed to have a convex-concave insole surface adapted to complement the concave-convex sole of the foot. Nevertheless, since the insole surface of leather shoes is generally made of a single leather sheet, the concave-convex shape thereof does not sufficiently conform with the sole shape of the foot. Particularly, in the arch portion of the foot where the convex portion formed in the insole surface of the shoes is not sufficiently high enough to neatly conform with the convex shape of the arch portion. In more conventional footgear such as slippers or clogs, the insole surface is relatively flat and is far from conforming with the convex-concave shape of the sole of the foot. The inventor has made various experimental studies with regard to fatigue caused by wearing footgear and has found that the fatigue from wearing footgear can be substantially reduced by applying proper pressure to the arch portion of the foot and giving the feeling of contact and moderate rubbing action to the arch portion.

SUMMARY OF THE INVENTION

Therefore, it is a primary object of the present invention to provide means for reducing fatigue from wearing footgear depending upon the abovementioned concept. This object is accomplished by placing a sheet piece on the insole of footgear so as to support only the arch portion of the foot.

When a sheet piece of the present invention is used with shoe, the sheet piece may conveniently be placed on the insole of a shoe in combination with an insole sheet adapted to be placed on the insole of the shoe. Therefore, another object of the present invention is to provide a combination of an insole sheet and a sheet piece for reducing fatigue from wearing footgear. The insole sheet being a synthetic resin sheet having a plurality of regularly arranged openings which open in the upper surface thereof at least in a region which corresponds to the arch portion of the foot. The piece includes a plurality of regularly arranged projections on the lower surface thereof which are adapted to engage with said openings wherein said sheet piece is mounted on said insole sheet in a manner to support only the arch portion of the foot. By providing a sheet piece of the abovementioned structure in combination with an insole sheet of the abovementioned structure, fine adjustment with regard to the position of mounting the sheet piece relative to the insole of a shoe is permitted by altering the engagement between said openings and said projections. In this connection, said openings may preferably be provided in the entire region of the insole sheet, whereby the insole sheet provides an improved ventilation for the sole of the foot and effectively protects the sole from sweating.

Still another object of the present invention is to provide a sheet piece for the abovementioned purpose which has a plurality of projections on its upper surface in order to improve the feeling which the sheet piece gives to the arch portion of the foot. By this arrangement, a pleasant feeling of contact and rubbing action are applied to the arch portion of the foot resulting in a reduction of fatigue due to wearing the footgear.

The thickness of the sheet piece which supports the arch portion of the foot in a manner to apply a pressure thereto should vary in accordance with persons who use the sheet piece because the degree of concavity in the arch portion of the foot varies according to the person. However, it is impractical to prepare a plurality of sheet pieces having different thickness when the sheet piece is supplied in combination with an insole sheet with which it engages. Therefore, it is still another object of the present invention to provide a combination of an insole sheet and first and second sheet pieces for reducing fatigue from wearing footgear, said insole sheet being a synthetic resin sheet having a first group of regularly arranged openings which open in at least the upper surface thereof and a second group of regularly arranged openings which open in at least the lower surface thereof. The first and second groups of openings are positioned at least in a region which corresponds to the arch portion of the foot. The first sheet piece includes a plurality of regularly arranged projections on the lower surface thereof which are adapted to engage with said first group of openings. The second sheet piece including a plurality of regularly arranged projections on the upper surface thereof which are adapted to engage said second group of openings. Wherein, said first and second sheet pieces are mounted to said insole sheet in a manner to support only the arch portion of the foot. In this combination, the pressure applied to the arch portion of the foot is determined by the sum the thickness of the first and second sheet pieces and the pressure can conveniently be adjusted by varying the thickness of said second sheet piece. The second sheet piece may be made as a smaller, thinner and less expensive sheet piece. Therefore, by supplying several pieces of different thicknesses of said second sheet piece for one combination of said first sheet piece and the insole sheet, the user can readily obtain a most suitable height for the convex portion in the sole which applies pressure to the arch portion of the foot as a result of selecting the proper thickness.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
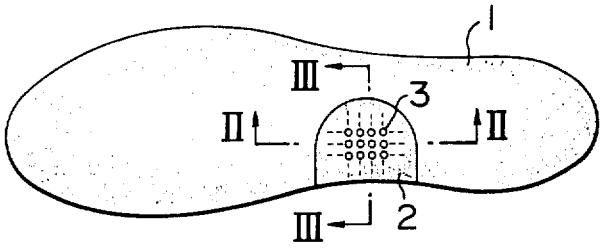
FIG. 1 is a plan view of an embodiment of the means for reducing fatique from wearing footgear according to the present invention, said means being mounted to the insole of a shoe.
Figure 2:
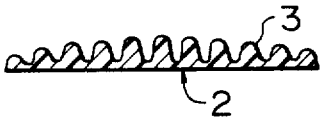
FIGS. 2 and 3 are sectional views along lines II—II and III—III in FIG. 1.
Figure 3:
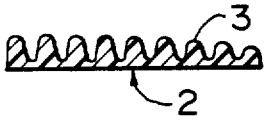

Referring to FIG. 1, 1 designates the insole of a shoe to which is attached a sheet piece 2 of the present invention at a portion corresponding to the arch portion of the foot. In the shown embodiment, the sheet piece 2 has projections 3 arranged on the entire surface thereof. As shown in FIG. 2, the projections are the highest at a central portion thereof and are gradually shortened toward the front and the rear ends of the sheet piece as seen in the longitudinal direction of the insole. As shown in FIG. 3, the projections are the highest at the outer edge portion of the arch of the foot and are gradually shortened toward the other lodge of the sheet piece as seen in the lateral direction of the insole. The sheet piece 2 may of course have a smooth surface without the projections 3, although the projections provide a more favorable effect in reducing fatique from wearing footgear by applying moderate stimulation to the arch portion of the foot. Furthermore, the projections provide ventilation spaces between the sole of the foot and the sheet piece thereby preventing sweating of the foot due to tight contact between the sole and the supporting sheet piece.

The sheet piece of the invention may be attached to the proper portion of the insole surface of the shoes, slippers, clogs, etc. by suitable adhesive or dual surface adhesive tape.

Figure 4:
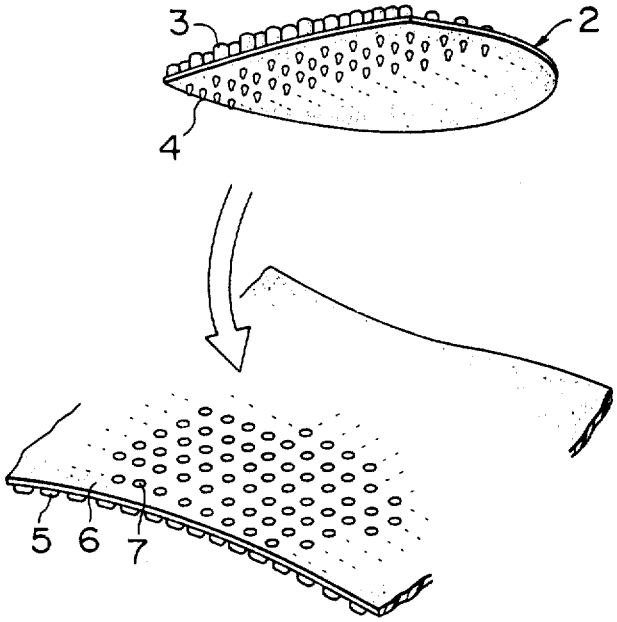
FIG. 4 is a perspective view showing another embodiment of the means for reducing fatigue from wearing footgear of the invention in combination with an insole sheet.

FIG. 4 shows another embodiment of the means for reducing fatigue from wearing footgear, in combination with an insole sheet.

In this embodiment, the sheet piece 2 includes a upper surface structure that is similar to the piece shown in FIGS. 2 and 3 but further includes projections 4 on its lower surface. On the other hand, the insole sheet 6 made of a synthetic resin sheet, comprises projections 5 regularly arranged on its lower surface and through openings 7 regularly arranged to open in the upper and the lower surfaces thereof. The arrangement of the projections 4 on the bottom surface of the sheet piece 2 correspond to that of the through openings 7 formed in the insole sheet 6. Thus by engaging the projections 4 into the openings 7, the sheet piece 2 is readily mounted to the insole sheet 6 in a suitable region of the sole sheet so that the sheet piece 2 provides the necessary support to the arch portion of the foot wearing the shoe in which the combination of the sole sheet 6 and the sheet piece 2 is inserted.

Figure 5:
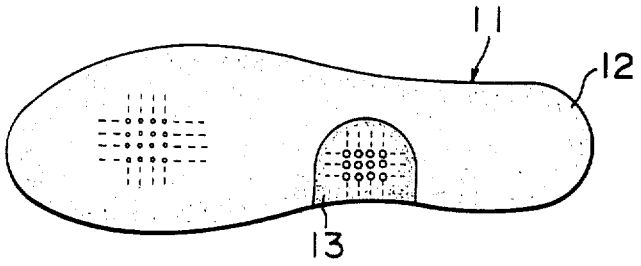
FIG. 5 is a plan view of an embodiment of a combination of the insole sheet and the sheet piece for reducing fatigue from wearing footgear according to the present invention.
Figure 6:
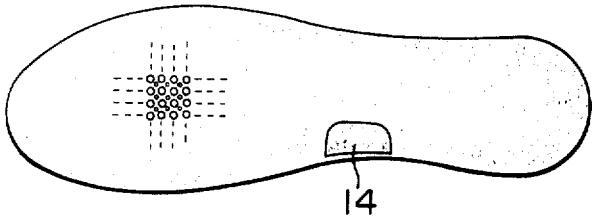
FIG. 6 is a bottom view of the combination shown in FIG. 5.
Figure 7:
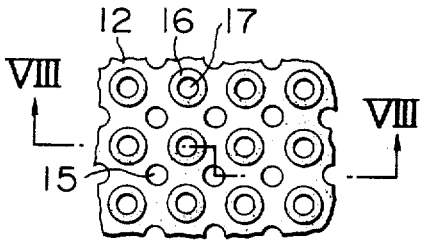
FIG. 7 is an enlarged partial bottom view of the insole sheet shown in FIGS. 5 and 6.
Figure 8:
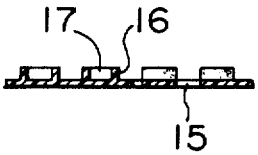
FIG. 8 is a sectional view along line VIII—VIII in FIG. 7.

FIGS. 5 and 6 show another combination of the insole sheet and the sheet piece for reducing fatigue from wearing footgear. The combination generally designated by 11 comprises an insole sheet 12, a first sheet piece 13 attached to the upper surface of the insole piece at a portion corresponding to the arch portion of the foot and a second sheet piece 14 attached to the bottom surface of the insole sheet similarly at a portion corresponding to the arch portion of the foot. The insole sheet 13 is formed with a first group of regularly arranged through openings 15 which traverse the thickness of the insole sheet as shown in FIGS. 7 and 8. Furthermore, the insole sheet has a plurality of regularly arranged short tubular projections 16 on the bottom surface thereof, said tubular projections defining a second group of regularly arranged openings 17.

Figure 9:
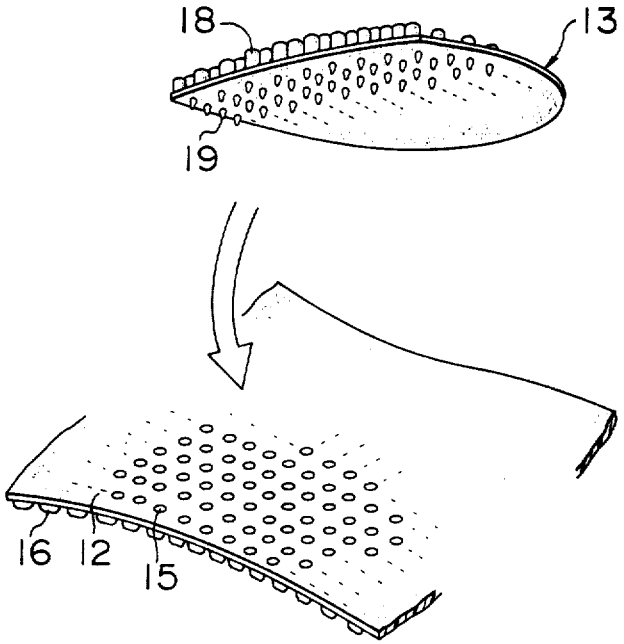
FIGS. 9 and 10 are perspective views showing the manner of engagement between the insole sheet and the first and second sheet pieces, respectively, in the combination shown in FIGS. 5 and 6.

As shown in FIG. 9, the first piece 13 has on its upper surface, a first group of projections 18 for simulating the arch portion of the foot and it also has on the bottom surface thereof a second group of projections 19 which engage with said first group of openings 15 in the insole sheet 12. By the projections 19 engaged into the openings 15, the sheet piece 13 is readily mounted to the upper surface of the insole sheet 12.

Figure 10:
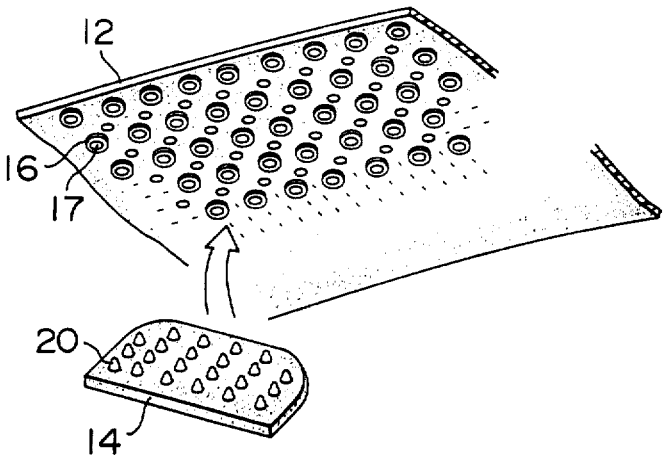

As shown in FIG. 10, the second sheet piece 14 has a plurality of projections 20 on its upper surface, said projections 20 being engagable into said second group of openings 17 provided by the tubular projections 16 formed on the bottom surface of the insole sheet 12. By the projections 20 being engaged into the openings 17, the second sheet piece 14 is also readily mounted to the bottom surface of the insole sheet 12.

Commercially, the first sheet piece 13 may be supplied as a single piece while, by contrast, said second sheet piece 14 should preferably be supplied as a set containing several kinds of pieces. For example, a first piece of the set may have a medium thickness to provide in cooperation with the single sheet piece 13 a convex means of a medium or average height for applying pressure to the arch portion of the foot; a second piece may be a little thicker to provide a higher convex means and a third piece may be a little thinner to provide a lower convex means. Of course, more than three pieces may be supplied as a set to provide a more gradually stepped variance in the height of the convex means to apply pressure to the arch portion of the foot.

Thus, in accordance with this embodiment, the present invention is able to provide a universal combination composed of a single insole sheet 12, a single first sheet piece 13 and several pieces of less expensive second sheet pieces 14 (of course the combinations are supplied as pairs including a pair of insole sheets, etc). Thus, every individual's personal preference for the height of the convex means for applying pressure to the arch portion of the foot may be achieved by a simple selection from several inexpensive small pieces which do not incur any substantial increase in cost when compared with the total cost of the combination.

Although the invention has been shown and described with respect to some preferred embodiments thereof, it should be understood by those skilled in the art that various changes and omissions in the form and detail thereof may be made therein without departing from the spirit and the scope of the invention.

I claim:

1. A combination of an insole sheet and first and second sheet pieces for reducing fatigue from wearing footgear, said insole sheet being a relatively flexible synthetic resin sheet having a first group of regularly arranged openings which open in at least the upper surface thereof and a second group of regularly arranged openings which open in at least the lower surface thereof, said first and second groups of openings being provided at least in a region which corresponds to the arch portion of the foot, said first sheet piece having a plurality of projections adapted to massage the arch portion of the foot on the upper surface thereof and a plurality of regularly arranged projections on the lower surface thereof which are adapted to engage with said first group of openings, said second sheet having a plurality of regularly arranged projections on the upper surface thereof which are adapted to engage with said second group of openings, wherein said first and second sheet pieces are mounted to said insole sheet at its upper and lower sides, respectively, in a manner to support only the arch portion of the foot.

2. The combination of claim 1, wherein said first openings are through openings which traverse the thickness of the insole sheet and said projections are tubular projections which define said second openings therein.

3. The combination of claim 2, wherein said insole sheet is provided with said first openings, said projections and said second openings over the entire region thereof.

4. The combination of claim 1, wherein said second sheet piece may be selected from a set of several pieces which vary in thickness.

5. The combination of an insole sheet and a first and second sheet pieces for reducing fatigue from wearing footgear wherein:

said insole sheet being a relatively flexible synthetic resin sheet including a first group of regularly arranged openings which open in at least the upper surface thereof and a second group of regularly arranged openings which open in at least the lower surface thereof;

said first and second groups of openings being provided at least in a region which corresponds to the arch portion of the foot;

said first sheet piece including a plurality of regularly arranged projections on the lower surface thereof which are adapted to engage with said first group of openings in said insole sheet;

said second sheet including a plurality of regularly arranged projections on the upper surface thereof which are adapted to engage with said second group of openings in said insole sheet; and wherein said first sheet piece is mounted to said insole sheet at the upper side and said second sheet piece is mounted to said insole sheet at the lower side in a manner to support only the arch portion of the foot;

whereby, the thickness of the arch portion of the insole sheet may be easily varied by merely varying the thickness of at least one of the first and second sheet pieces.

* * * * *